United States Patent [19]

Gueret

[11] Patent Number: 5,011,317

[45] Date of Patent: Apr. 30, 1991

[54] DISPENSER INCLUDING A TRANSLATABLE PISTON

[75] Inventor: Jean-Louis Gueret, Paris, France

[73] Assignee: L'Oreal, Paris, France

[21] Appl. No.: 474,326

[22] Filed: Feb. 2, 1990

[30] Foreign Application Priority Data

Feb. 8, 1989 [FR] France ..... 89 01612

[51] Int. Cl.[5] ..... B43K 21/18

[52] U.S. Cl. ..... 401/66; 401/179

[58] Field of Search ..... 401/65, 66, 67, 80, 401/92, 179

[56] References Cited

U.S. PATENT DOCUMENTS

| | | | |
|---|---|---|---|
| 1,546,516 | 7/1925 | Smith | 401/66 |
| 1,975,723 | 10/1934 | Johnsson | 401/66 |
| 2,528,839 | 8/1946 | Mason . | |
| 2,541,949 | 5/1947 | Thacker . | |
| 2,718,299 | 9/1955 | Atwater et al. | 401/66 X |
| 2,771,858 | 10/1956 | Cribbs et al. | 401/66 |
| 4,659,327 | 4/1987 | Bennett et al. | 401/66 X |

FOREIGN PATENT DOCUMENTS

| | | | |
|---|---|---|---|
| 0094764 | 5/1983 | European Pat. Off. . | |
| 493215 | 8/1919 | France | 401/66 |
| 991925 | 10/1951 | France . | |
| 608084 | 9/1948 | United Kingdom | 401/66 |
| 2202733 | 3/1988 | United Kingdom . | |

*Primary Examiner*—Danton D. DeMille

*Attorney, Agent, or Firm*—Cushman, Darby & Cushman

[57] ABSTRACT

The dispenser (1) includes a body (2) made of two separable parts (*2a; 2b*). The front part (*2a*) receives a reservoir (4), containing the product (3) to be dispensed, between an outlet opening (5) and a piston (6), which is controlled by a rod (7) that is displaceable translationally and incrementally by a mechanism (8) housed in the rear part (*2b*). The rod (7) includes rear catches (*29a*) and front catches (*29b*) that normally mesh with the notches (22), and elastic regions (28) between the catches that exert a restoring force on a pushbutton (9) closing the rear part (*2b*). Rotation of the pushbutton (9) by 90 degrees drives the cage in rotation and puts it in a position in which the catches bear on the flats (21), which disengages the mechanism. In the engaged position, any thrust on the pushbutton brings about an advancement of the rod (7) equal to one notch in a rack.

14 Claims, 2 Drawing Sheets

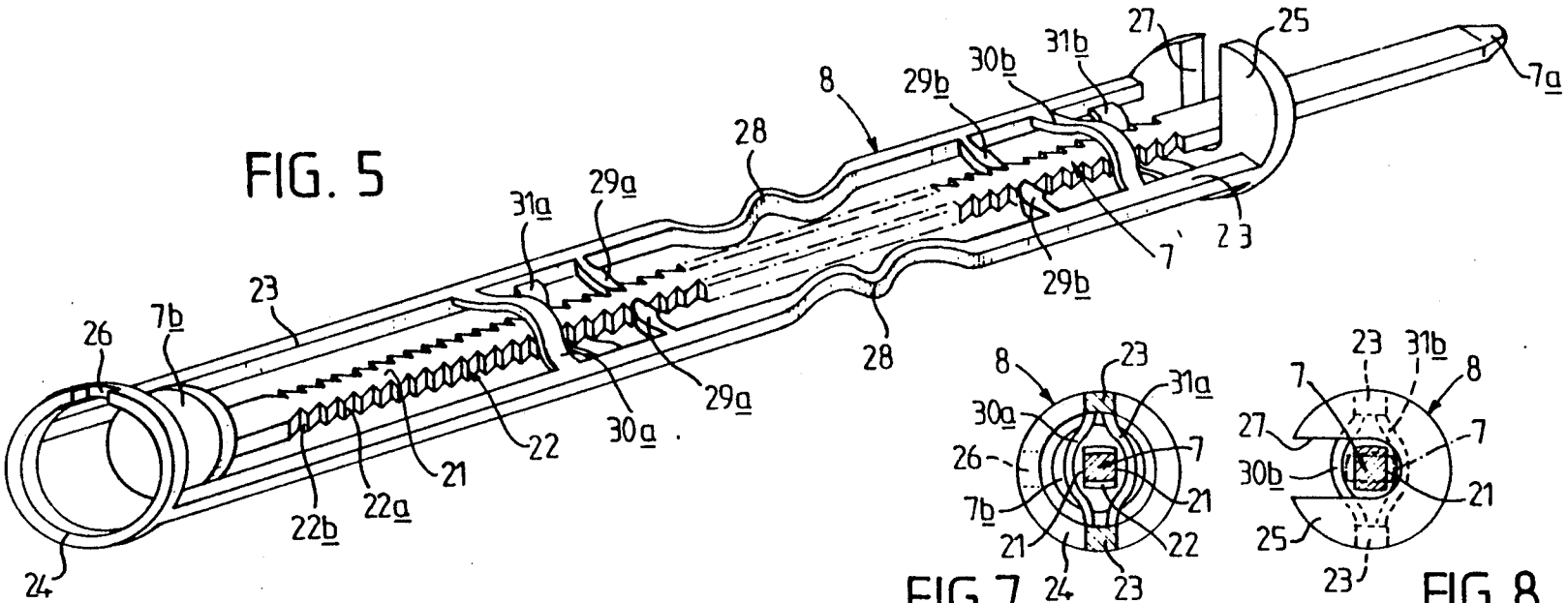
FIG. 5
FIG. 8
FIG. 7
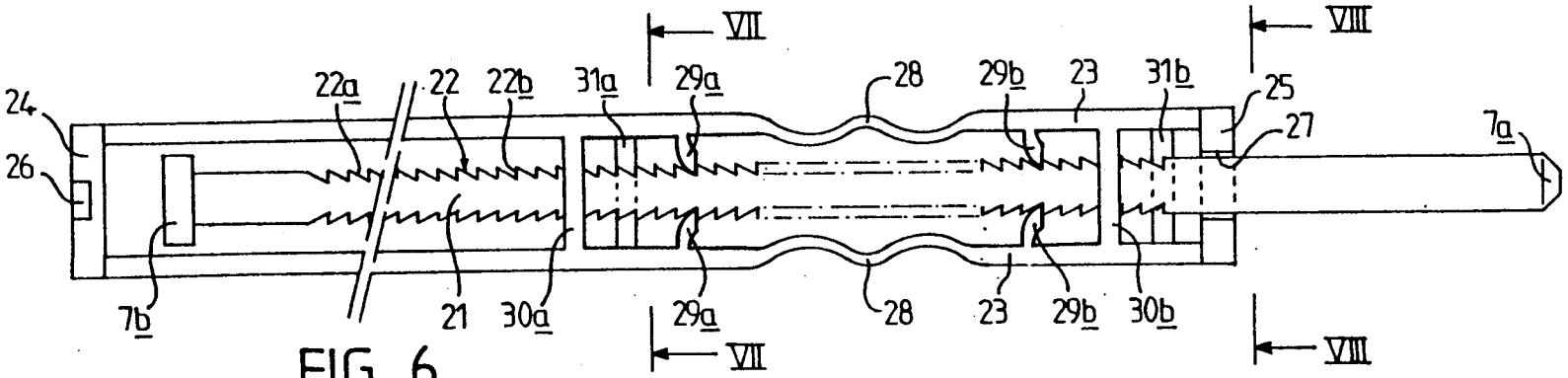
FIG. 6

DISPENSER INCLUDING A TRANSLATABLE PISTON

FIELD OF THE INVENTION

The present invention relates to a dispenser for a product, in particular a compact, solid or paste product, which is pushed incrementally into a reservoir by a piston subjected to translation controlled by the user. Such a device may be used for dispensing and advantageously applying makeup products, for example, or dermatological and cosmetic treatment products that can be spread onto the skin or peeled off, in particular a lipstick, a molded or compacted powder, an ointment, a stick, or an emulsion of pasty consistency, or a viscous liquid.

BACKGROUND OF THE INVENTION

Dispensers of the type described above are already on the market. In these dispensers, the piston that pushes the product to be dispensed in the direction of the dispensing opening is mounted on the end of a threaded rod, which cooperates with a fixed nut integrally joined to the reservoir containing the product. The threaded rod is displaceable in rotation by means of a mechanism that converts the action of the user on a pushbutton of the dispenser into a rotation of slight angular amplitude; the rotation of the threaded rod, which cooperates with the aforementioned fixed nut, is converted into translation of the rod with respect to the reservoir, the amplitude of the translation being increasingly small, the smaller the rotation of the rod, on the one hand, and the smaller the pitch of the thread of the rod, on the other. For each action upon the pushbutton of the dispenser, a translation of several tenths of a millimeter is obtained, which is entirely satisfactory for dispensing the product. A dispenser of this type that can be used for a liquid product is described in particular in French Patent 2 555 471.

However, the mechanism disposed between the pushbutton and the piston is very expensive, partly because of the number of parts comprising it and partly because of the complexity of molding of the parts, as well as the difficulty of assembling the mechanism. The function of such a mechanism is irreversible; when the piston arrives in the vicinity of the reservoir dispensing opening, it cannot be made to move backward in order to refill the reservoir; the only way to reverse it would be to screw the threaded rod backward in its nut, but it is understandable that the user would not think of that. As a result, the mechanism of such a dispenser must be considered a throwaway item, and its cost considerably increases the cost price of the dispenser filled with the product to be dispensed.

To overcome these disadvantages, it has been proposed, in French Patent Application 88-05026 filed on April 15, 1988, that the support of the mechanism enabling the incremental rotational displacement of the threaded rod, which is likewise the support or the nut, includes a means of integral attachment to the reservoir, making the reservoir detachable with respect to this support; that the nut, which cooperates with the threaded rod, is slit along at least one diametral plane over the entire height of its threaded bore, with the sectors of the nut then being kept together by a flexible zone that assures the fixation of the nut on the support; and that the reservoir includes a frustoconical bearing that when the detachable reservoir is attached to the support presses against a corresponding frustoconical bearing of the nut and/or support, in order to assure the squeezing of the sectors of the nut around the threaded rod driven by the mechanism. With such a structure, the intended object can be attained, that is, to re-use the same mechanism for dispensing the product from several reservoirs in succession. Nevertheless, the mechanism itself remains the same as the type described in French Patent 2 555 471, that is, a mechanism, that is intrinsically very expensive, for the reasons already given above.

SUMMARY OF THE INVENTION

The object of the present invention is to propose a dispenser of the type defined above, in which, as in French Patent Application 88-05026 the reservoir is interchangeable, because of the possibility of returning the threaded rod into the support of the mechanism to enable adapting a new refill to it, but in which the complex mechanism of French Patent 2 555 471 is replaced with a much simpler mechanism, which thus reduces the overall price of the dispenser and makes it easier to exploit commercially.

To this end, the present invention proposes a mechanism for controlling the feed of the rod that can advantageously be made in one piece, cooperating via two latching zones with a set of serrations located on the rod; an elastic zone of the mechanism is disposed between the two latching zones and separates the mechanism into a fixed portion with respect to the reservoir, in a position for dispensing the product, and a movable portion associated with the maneuvering device, which is advantageously made in the form of a pushbutton; the aforementioned elastic zone assures the return to the normal position. The reservoir per se is arranged to be capable of being detached from the rest of the dispenser once dispensing has been completed, in which case the rod is in the completely projected position. To return it to its initial position, it is provided that the pushbutton can be pivoted, driving the mechanism to rotate and placing the rod in a new position with respect to the mechanism in which it can easily be retracted to its initial position for distribution, because the latching zones then no longer face a set of serrations of the rod but rather a flat zone thereof, while the rod itself is rotationally blocked.

Hence the present invention relates to a dispenser of a product contained in a cylindrical reservoir of arbitrary cross section, in which the product is disposed between the dispensing opening and a piston that is displaceable translationally in the reservoir, the piston being mounted at the end of a rod that is incrementally displaceable by means of a mechanism controlled by action of the user on a translatable maneuvering device that is located on an element associated with the reservoir and can be displaced, for translating the piston and dispensing the product. This dispenser is characterized in that in the first place, the mechanism includes one portion that is fixed with respect to the reservoir and another portion that is movable with respect to this reservoir; the two portions, fixed and movable, are separated by an elastic zone, the maneuvering device being solidly joined in translation with the movable portion of the mechanism and being subjected to the restoring action of the elastic zone in order to be moved into its position of repose after action by the user. In the second place, the rod is immobilized rotationally with respect to the element and in order to be driven in translation includes a rack system that cooperates with the mechanism via latching means; by rotation about the rod, the mechanism is capable of assuming either an engaged position, where the latching means cooperate with the rack system, or a disengaged position where the rod is free with respect to the mechanism, the latching means then being deactivated.

Preferably, the latching means include two latches located on either side of the elastic zone, one of the latches being located on the movable part of the mechanism and the other being located on the fixed part of the mechanism.

Advantageously, the rod includes, parallel to its axis, at least one substantially smooth zone on which the latching means rest in the disengaged position of the mechanism. The rod may include two longitudinal flats disposed symmetrically with respect to its axis and two racks disposed between the two aforementioned flats and cooperating with the latching means, the direction in which the two racks are driven being that which causes a shift from the movable portion to the fixed portion of the mechanism. Each latch of the mechanism includes two catches disposed symmetrically with respect to the rod and each cooperating with one of the racks.

In a variant, the pitches of the two racks are different, and each latch includes a single catch, the two catches being disposed on the same side of the rod and cooperating with the same rack.

Preferably, the maneuvering device is rotatably connected to the movable part of the mechanism. The reservoir may be detachable from the element to which it is assembled.

In a preferred embodiment, the element which has the maneuvering device is a tubular body, one end of which includes a means for attachment to the reservoir or to a tubular joining piece surrounding it, this body being closed at its end opposite the reservoir by the maneuvering device.

In that case, the maneuvering device is a pushbutton capable of sliding in the tubular body, and with one of its free ends of its movable portion the aforementioned mechanism rests against the bottom of the pushbutton, while with its opposite free end it rests against a shoulder of the tubular body. The shoulder defines a passage enabling the sliding of the rod for dispensing the product, but preventing the rotation of the rod.

According to a particularly advantageous embodiment of the invention, the mechanism is made in the form of a cage cast by molding of a relatively flexible plastic material, and comprising two lateral branches, a median zone of which is corrugated, in the plane of the branches, to comprise an elastic zone; the lateral branches are connected on one end to a ring, which is in contact with the bottom of the pushbutton and has a means that is complementary to a means located on the pushbutton in order to rotatably attach the pushbutton and the mechanism, and on the other end to a disk, which is in contact with the shoulder and is provided with a slit enabling the sliding of the rod and the pivoting of the mechanism with respect to the rod.

These two branches of the mechanism are advantageously connected transversely by bracing bridges disposed in the median zones of the fixed and movable parts of the mechanism.

In accordance with further details of the embodiments, the tubular body includes a means for centering the fixed part of the mechanism; the reservoir, or the tubular joining piece surrounding it, is assembled to the tubular body by screwing, or by latching; and the reservoir, or the tubular joining piece surrounding it, and the tubular body are disposed in the extension of one another.

The subject of the present invention will be better understood from the ensuing detailed description, made by way of purely illustrative, non-limiting examples, of two embodiments shown in the accompanying drawings.

BRIEF DESCRIPTION OF THE DRAWINGS

FIGS. 5 and 6, respectively, are perspective and plan views of the mechanism for controlling the piston, not showing the end pushbutton; and FIGS. 7 and 8 are cross-sectional views taken along the lines VII—VII and VIII—VIII, respectively, of FIG. 6.

DESCRIPTION OF THE PREFERRED EMBODIMENTS

Figure 1:
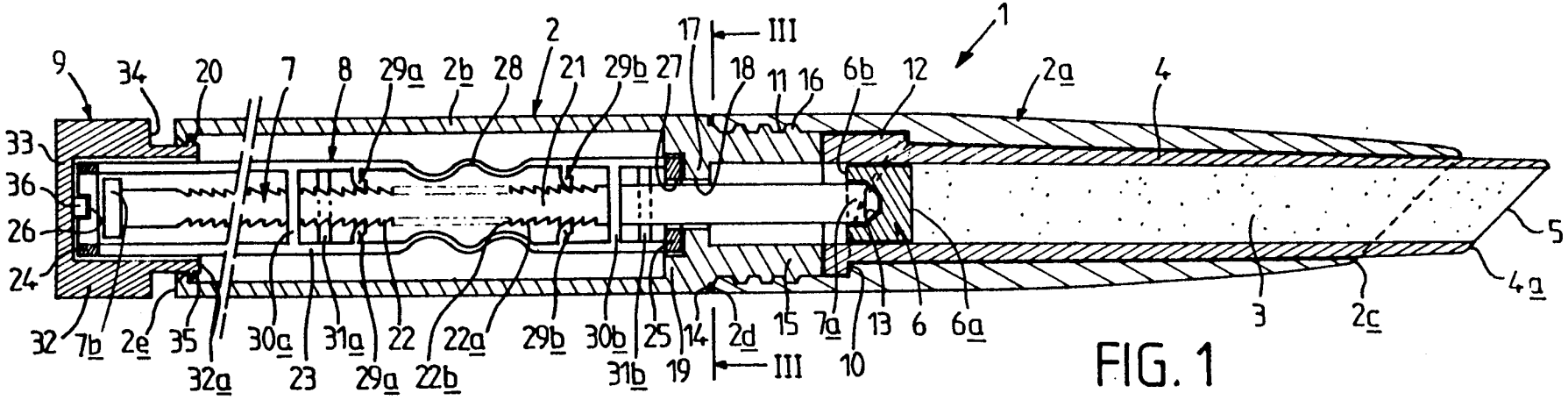
FIG. 1 is a fragmentary longitudinal sectional view of a dispenser in a first exemplary embodiment of the invention, in the position corresponding to the initial phase of dispensing of the product with which the reservoir is filled, the control mechanism of the piston being shown in a plan view, as it appears in FIG. 6, for the sake of better understanding of the drawing.

Turning now to FIG. 1, it is seen that reference numeral 1 indicates the entirety of a dispenser including an elongated housing 2 made in two parts **2*a*, 2*b***, which are each located in the extension of the other and are joined by being screwed together.

Part **2*a* is a tubular joining piece; the product 3 to be dispensed is accommodated in a reservoir 4, the joining piece 2*a* of which comprises a sheath. The product 3 is disposed in the reservoir 4 between the dispensing opening 5 and a piston 6. The piston is incrementally displaceable by translation in the reservoir 4 via a serrated rod 7, which in turn is controlled by a mechanism 8; the rod 7 and the mechanism 8 are received in the part 2*b* of the body 2. The mechanism 8 is integrally joined to a pushbutton 9 mounted at the end of the part 2*b*** that comprises the tubular body of the distributor.

The joining piece **2*a* is an elongated tubular element that tapers slightly from the outside in the direction of its free end 2*c*, which is located in an oblique plane with respect to the median line of the joining piece. The internal conduit of the joining piece 2*a* receives the reservoir 4; it is cylindrical and has a setback 10 toward the outside, some distance from its end 2*d* opposite the oblique end 2*c*; the setback is in the form of a helical ramp, the role of which will be described hereinafter. Between the setback 10 and the end 2*d* and in the vicinity thereof, the joining piece 2*a* includes a thread 11**, the role of which will also be described hereinafter.

The reservoir 4 comprises a hollow cylinder, the free end 4a of which is likewise inclined with respect to its median line and in the assembled position is intended to be placed parallel to the plane containing the end 2c of the joining piece, protruding slightly from it. The correct orientation of the joining piece 2a and reservoir 4 is assured by the fact that the reservoir, at its end opposite its free end 4a, includes an external bead 12 that is complementary with the helical setback 10. Moreover, it may be provided that the joining piece of the reservoir 4, projecting beyond the part 2a of the body 2, is lined with a flocked material, a spongy material, or a felt, to allow the product 3 to be applied directly to the skin. In the case where a substance of semiliquid consistency is to be dispensed, it may also be provided that this joining piece projecting from the reservoir 4 is equipped with a short hollow center punch, for the same purpose.

The piston 6 is a cylindrical element defined by a front plane face 6a resting on the product 3 and a rear face 6b including an axial cavity 13 of substantially frustoconical shape, which is intended to receive the end 7a, of adapted shape, of the rod 7. The piston 6, arranged to slide in the reservoir 4, in a sealed manner if needed, may be provided with a hole (not shown) for the escape of air, the hole being such that it is plugged by the end 7a of the rod in the position of use.

Figure 3:
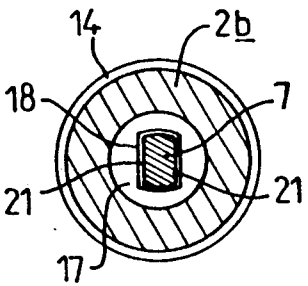
FIG. 3 is a cross section taken along the line III—III of FIG. 1.

The tubular body 2b of the housing 2 is a cylindrical element, which in the vicinity of its end intended for cooperation with the joining piece 2a has an annular setback 14 toward the interior, beyond which it forms a neck 15 including an external thread 16 intended to cooperate with the internal thread 11 of the joining piece 2a. At the level of the setback 14, the body 2b includes an internal annular shoulder 17, defining a central passage 18 the shape of which corresponds to that of the cross section of the rod 7, as can be seen from FIG. 3. Taking into account the particular shape of the rod 7, which is described hereinafter, the shoulder 17 assures rotational blocking of this rod 7. However, there is a certain amount of play between the edge defining the passage 18 and the rod 7, to permit the progression of the rod when the product 3 is dispensed. Moreover, at the rear of the shoulder 17 with respect to the neck 15, the body 2b has an annular bead 19 defining a cylindrical zone for centering the mechanism 8, as indicated below. Finally, on its end 2e, the body includes an annular internal flange enabling retention of the pushbutton 9, as is also described hereinafter.

The serrated rod 7, as can be seen from FIGS. 5 and 6, is constituted by an elongated flat element including one end 7a, which has a trapezoidal shape when viewed from above; on the opposite end, the rod 7 includes a plate 7b of disk shape, which is disposed in a plane perpendicular to the median line of the rod 7 and the axis of which coincides with it. This plate 7b serves as a stop when the retraction of the rod 7 is performed at the end of the dispensing, and it also serves as a travel limiter for the rod 7, as will be described below. The rod 7 includes two opposed flats 21, and on its two opposite remaining faces, except in the zones adjoining the end 7a and the plate 7b, where it remains smooth, it is provided with notches 22 made along its thickness, each notch being defined by one oblique wall 22a that is recessed toward the plate 7b and one wall 22b that is substantially perpendicular to the axis of the rod 7.

The mechanism 8, as can be seen particularly in FIG. 5, forms an elongated cage, including two lateral branches 23 that are parallel to one another and are joined at one end to a ring 24 and at the other to a disk 25, parallel to the ring 24; the branches 23 are joined at diametrically opposed zones, of both the ring 24 and disk 25. The ring 24 includes a recess 26, formed in its wall facing the outside and between the two branches 23; the role of this recess is indicated below. The disk 25 includes a U-shaped slit 27, made along a diametrical line of the disk 25, having a depth greater than the radius of the disk and a width slightly greater than that of the flats 21.

The branches 23 each include a flexible compressible median zone 28, which is made by accordionlike folding formed in the plane containing the two branches 23. On either side of these flexible zones 28, the branches 23 include a pair of opposed tongues, that is, rear tongues 29a and front tongues 29b, which function as catches, by engaging the rack notches 22 facing the rod 7 in the position for dispensing.

A crosswise strengthening link between the branches 23 is assured by two rear bracing bridges 30a–31a, and two front bracing bridges 30b–31b, which are located between the ring 24 and the catches 29a and between the catches 29b and the slit disk 25, respectively. From the viewpoint of FIG. 5, the bridges 30a and 30b are disposed above the rod 7, and the bridges 31a and 31b are disposed under it, being offset with respect to the others; taken all together, they form a cradle in which the rod 7 can be displaced.

The mechanism 8 that has just been described comprises a part that can be made all in one piece by molding a relatively flexible plastic material in order to make the flexible parts 28; the mold joint is the median plane of the two branches 23. The pushbutton 9 comprises a lateral skirt 32 joined to a bottom 33. The skirt 32 includes a square setback 34 from its outer wall, at a distance from its free end 32, where it has an external bead 35 intended to engage the bead 20 from behind, in order to solidly join the pushbutton 9 and the body 2b. The pushbutton 9 is normally pushed back into its position in which it is shown in FIG. 1 by the elastic force of the part 23 of the mechanism 8; the ring 24 always rests against the bottom 33 of the pushbutton 9. Depressing the pushbutton 9 until the setback 34 comes to a stop against the end 2e of the body 2b takes place over a distance on the order of 0.5 mm to 5 mm, for example, corresponding to one notch 22 of the serrated rod 7, depending on the amount of product 3 to be dispensed. Moreover, the bottom 33 includes a fin 36 that cooperates with the recess 26 of the ring 24 of the mechanism 8, which permits the rotational drive of the mechanism 8 by the pushbutton 9.

The initial assembly of the dispenser 1 is accomplished as follows:

In the body 2b, the mechanism 8 is put in place, having been equipped beforehand with its rod 7, and the teeth of the rod 7 mesh with the catches 29a, 29b. The mechanism is introduced via the end 2e of the body 2b. Next, the pushbutton 9 is placed on this end 2e by latching it with force. Next, the subassembly comprising the reservoir 4, its associated piston 6, and its sheath 2a is screwed onto the body 2b.

The dispenser functions as follows:

Initially the dispenser 1 is located in the position that it occupies in FIG. 1: The mechanism 8 extends between the bottom 33 of the pushbutton 9 and the shoulder 17, guided at the rear by the skirt 32 of the pushbutton 9 and centered at the front by the annular bead 19. When the user exerts pressure on the pushbutton 9 to cause it to come to a stop against the back of the body 2b, the rear portion of the mechanism 8 — between the ring 29 and the flexible portions 28 — moves forward to the right, from the viewpoint of FIG. 1, this rear portion comprising the movable part of the mechanism 8; the flexible portions 28 fold in accordion fashion, and the rod 7 is driven toward the reservoir 4 by the rear catches 29a, which, resting against the faces 22b of the corresponding notches 22, are buttressed against the rod 7. On the other hand, the front catches 29b, resting on the oblique faces of the corresponding notches 22, are lifted and drop into the following notches 22, immediately to the rear. The rod 7, having advanced by one increment, has thus enabled the emergence from the edge 4a of a metered amount of product 3, which the user may pick up or apply to the skin, as needed.

In the meantime the user has relaxed the pressure on the pushbutton 9, so that the flexible portions 28, which were accordion-folded when pressure was exerted on the pushbutton 9, now resume their initial position shown in FIG. 1, but this time the front catches 29b keep the rod 7 immobile with respect to the body 2 by being braced against the faces 22b of the notches 22, while the rear catches 29a slide over the oblique faces 22a and drop into the next notches 22, immediately to the rear. The dispenser 1 is then ready for the distribution of the next metered amount by re-actuation of the pushbutton 9. Placing the plate 7b in contact with the bracing bridge 30a comprises a limitation for the travel of the rod 7.

In a variant, not shown, the cage of the mechanism 8 has catches 29a, 29b only on one of its branches 23; the pitch of the notches 22 of the rack located on one of the faces of the rod 7 is twice the pitch of the notches 22 of the rack located on the opposite face of this rod. Depending on whether one or the other of the racks is made to cooperate with the catches 29a, 29b, this makes it possible to obtain a mechanism with normal incremental feeding, or rapid incremental feeding; the fast-feed mechanism makes it possible to remove double doses of product from the reservoir 4. In particular, it may be provided that the user himself can regulate the amounts of product dispensed each time the pushbutton 9 is actuated, by causing the rod 7 to pivot by 180 degrees with respect to the cage of the mechanism, so that one or the other of the racks 22 is made to cooperate selectively with the catches 29a, 29b. A rod 7 of this type including two racks of different pitches also makes it possible to use the same type of serrated rod for different products, and in particular products for which one uses different quantities of dispensed product. It is understood that any desired value may be given to the spacing of the two racks, with the ratio of one to two having been given here only by way of example.

If the reservoir 4 is interchangeable, as is the case for the two embodiments shown here, then when all the product 3 contained in the reservoir 4 has been dispensed the rod 7 must be made to return, so that it resumes its initial position. At that moment, the user rotates the pushbutton 9 by a one-quarter turn; the mechanism 8 is driven to rotate by reason of the cooperation of the fins 36 with the recess 26, and the notch 7, blocked in rotation in the shoulder 17, is now located, with respect to the mechanism 8, in the position shown in dot-dashed lines in FIG. 8. If the joining piece 2a is separated by unscrewing, then it is easy to push the rod 7 back toward the back, because the rod is oriented such that the catches 29a, 29b are located facing the flats 21 of this rod 7. The rod 7 can thus be pushed all the way to the back, until the plate 7 comes to a stop against the bottom 33 of the pushbutton 9.

Once the user has removed the empty reservoir 4 by pivoting exerted on the end 4a with respect to the joining piece 2a, the user puts a new reservoir 4 in place, which is filled with the product 3 to be dispensed, along with its associated piston 6, by engaging it with its end 4a in the joining piece 2a having the thread 11, and causing it to pivot to put the helical parts 10 and 12 in coincidence with one another. The parts 2a and 2b need merely be screwed together and a new distributor 1 is ready for use, after a new rotation by a one-quarter turn of the pushbutton 9 with respect to the body 2b has allowed the catches 29a, 29b to enter the notches 22. Dispensing can thus commence immediately. The option of keeping the dispenser in a disengaged position (before the new one-quarter turn rotation of the pushbutton 9) is a safety measure, used for example for carrying the dispenser in a handbag.

Figure 4:
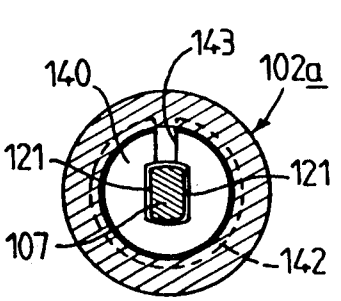
FIG. 4 is a cross section taken along the line IV—IV of FIG. 2.
Figure 2:
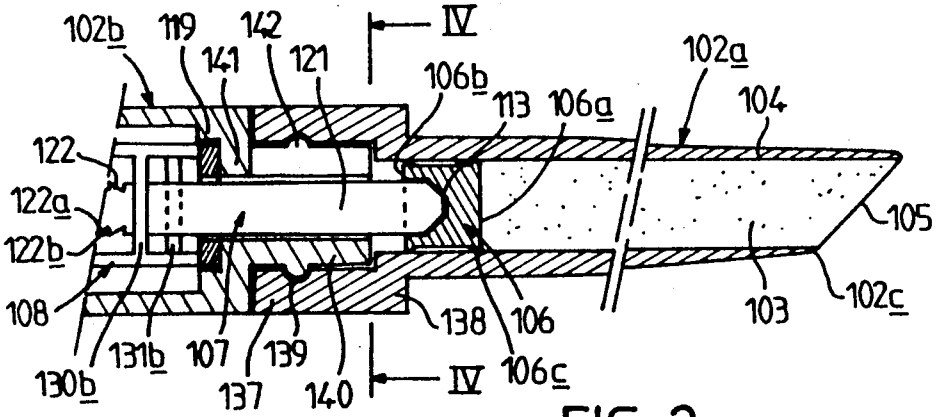
FIG. 2 is a fragmentary longitudinal axial section of a dispenser according to a second embodiment of the invention; only the zone including the reservoir, the piston and the portion adjoining its control mechanism is shown, because the remainder of the dispenser is embodied as shown in FIG. 1.

Turning now to FIGS. 2 and 4, it is seen that a dispenser 101 has been shown in a variant, in which the front part or joining piece 102a of the housing 102 is constituted by a tubular element 104, which is the counterpart to the reservoir 4 of the first embodiment. In its rear portion, this element 104 includes a terminal skirt 137 larger in diameter than the element 104 and joined to it by an annular shoulder 138. The terminal skirt 137 includes an annular throat 139, the role of which will be described below.

The body 102b of the housing 102 is terminated, in its part intended for cooperation with the joining piece 102a, by a neck 140 belonging to the body 102b. The neck 140 is defined by a shoulder 141, which is the equivalent of the shoulder 17 of the first embodiment, and which assures the rotational blocking of the rod 107 in the assembled position.

The neck 140 includes a sealing ring 142 intended for cooperation with the groove 139; the neck is also slit longitudinally, from one end to the other, the slit 143 being shown in FIG. 4 and having the role of promoting the latching maneuver that solidly joins the two parts 102a and 102b of the housing 102.

The piston 106 associated with the reservoir 104 is identical to the piston 6 of the first embodiment, except that it includes peripheral sealing beads 106c, to assure perfectly sealed sliding of the piston 106 in the internal conduit of the reservoir 104.

Otherwise, the elements comprising the dispenser 101 are identical to those of the dispenser 1, and they are identified by the same reference numerals as those used to designate the similar elements of the first embodiment, except that here they are raised in each case by 100. Accordingly, the function of the dispenser 101 is identical in all points to that of the dispenser 1.

It will be understood that the embodiments described above are in no way limiting and may be modified in any desirable way without departing from the scope of the invention.

What is claimed is:

1. A dispenser for a product including a cylindrical reservoir for the product, said reservoir having a dispensing opening at one end thereof and a movable piston disposed therein for translation in said reservoir, drive means including a rod having one end connected to said piston, said drive means being actuatable by a user upon actuation of a maneuvering device to incrementally displace said rod, said maneuvering device being carried on a support element assocated with said drive means, said drive means including one end portion that is fixed relative to said reservoir and another end portion that is movable relative to said reservoir, said and portions being connected by an elastic zone, said maneuvering device by the user from an initial position of repose with said elastic zone returning said another end portion and maneuvering device to the initial position, means for restraining said rod against rotation relative to said support element, said rod and drive means having interengaging rack means including latching means for transmitting movement from said drive means to said rod, said latching means engaging said rod when in one position of rotation and disengaged from said rod when in another position of rotation relative to said latching means, wherein said reservoir is detachable from the support element onto which it is assembled, said support element being a tubular body, one end of which includes a means for attachment to the reservoir said reservoir including one and which surrounds said means for attachment, said body being closed at its end opposite the reservoir by a maneuvering device, said maneuvering device being a pushbutton capable of sliding in the tubular body, said drive means comprising a cage cast by molding of a relatively flexible plastic material, and comprising two lateral branches, said elastic zone comprises a median zone which is corrugated, in the plane of said branches.

2. The dispenser as defined by claim 1, characterized in that the latching means include two latches (29*a*, 29*b*) located on either side of the elastic zone (28), one of the latches (29*a*) being located on the movable end portion of the drive means and the other (29*b*) being located on the fixed portion.

3. The dispenser as defined by one of claim 2, characterized in that the rod (7; 107) includes, parallel to its axis, at least one substantially smooth zone on which the latching means (29*a*; 29*b*) rest in the disengaged position of the mechanism (8; 108).

4. The dispenser as defined by claim 3, characterized in that said at least one substantially smooth zone comprises two longitudinal flats (21) disposed symmetrically with respect to the axis of said rod and said rack means comprises two racks (22) disposed between the two aforementioned flats and cooperating with the latching means (29*a*, 29*b*), the direction in which the two racks are driven being that which causes a shift from the movable portion to the fixed portion of the drive means.

5. The dispenser as defined by claim 4, characterized in that each latch includes two catches disposed symmetrically with respect to the rod (7; 107) and each cooperating with one of the racks (22).

6. The dispenser as defined by claim 5, characterized in that the pitches of the two racks (22) are different, the two catches being disposed on the same side of the rod (7; 107) and cooperating with the same rack (22) and said rod (7) being rotatable through 10° relative to said cage of said drive means so as to permit one of said racks to cooperate selectively with said catches.

7. The dispenser as defined by claim 1, characterized in that the maneuvering device (9) is rotatably connected to the movable end portion of the drive means.

8. The dispenser as defined by claim 1, characterized in that a shoulder (17; 141) defines a passage enabling the sliding of the rod (7; 107) for dispensing the product (3; 103), but preventing the rotation of the rod.

9. The dispenser as defined by claim 8, characterized in that said lateral branches being connected on one end to a ring (24) that is in contact with the pushbutton (9) and has a means complementary to a means located on the pushbutton in order to rotatably attach said pushbutton (9) and the drive means, and on the other end to a disk (25), which is in contact with the shoulder (17; 141) and which is provided with a slit (27) enabling the sliding of the rod (7; 107) and the pivoting of the mechanism (8; 108) with respect to the rod.

10. The dispenser as defined by claim 9, characterized in that the two branches are connected transversely by bracing bridges (30*a*–30*b*; 31*a*–31*b*) disposed in the fixed and movable portions of the drive means.

11. The dispenser as defined by claim 10, characterized in that the tubular body (2*b*; 102*b*) includes a means (19; 119) for centering the fixed portion of the drive means.

12. The dispenser as defined by claim 11, characterized in that the reservoir (104) is assembled to the tubular body (2*b*; 102*b*) by screwing.

13. The dispenser as defined by claim 11 characterized in that the reservoir (4) is assembled to the tubular body (2*b*; 102*b*) by latching.

14. The dispenser as defined by 11, characterized in that the reservoir (104), and the tubular body (2*b*; 102*b*) are disposed in the extension of one another.

* * * * *